US009902464B2

(12) United States Patent
Cottrell et al.

(10) Patent No.: US 9,902,464 B2
(45) Date of Patent: Feb. 27, 2018

(54) BENDING STIFFNESS REDUCER FOR BRACE TO HULL CONNECTION

(71) Applicants: Roy Cottrell, Houston, TX (US); Barton Grasso, Houston, TX (US); Frank Strachan, Houston, TX (US); Jose H. Vazquez, Houston, TX (US)

(72) Inventors: Roy Cottrell, Houston, TX (US); Barton Grasso, Houston, TX (US); Frank Strachan, Houston, TX (US); Jose H. Vazquez, Houston, TX (US)

( * ) Notice: Subject to any disclaimer, the term of this patent is extended or adjusted under 35 U.S.C. 154(b) by 0 days.

(21) Appl. No.: 15/448,314

(22) Filed: Mar. 2, 2017

(65) Prior Publication Data

US 2017/0253298 A1 Sep. 7, 2017

Related U.S. Application Data

(60) Provisional application No. 62/302,905, filed on Mar. 3, 2016.

(51) Int. Cl.

| | |
|---|---|
| ***B63B 35/44*** | (2006.01) |
| ***B63B 1/12*** | (2006.01) |
| ***B63B 3/14*** | (2006.01) |
| ***B63B 1/10*** | (2006.01) |

(52) U.S. Cl.

CPC ..... *B63B 1/121* (2013.01); *B63B 1/107* (2013.01); *B63B 3/14* (2013.01); *B63B 35/44* (2013.01); *B63B 35/4413* (2013.01); *B63B 2035/448* (2013.01)

(58) Field of Classification Search

CPC ..... B63B 35/44; B63B 1/107; B63B 1/121; B63B 3/14

See application file for complete search history.

(56) References Cited

U.S. PATENT DOCUMENTS

| | | | | |
|---|---|---|---|---|
| 3,215,108 | A * | 11/1965 | Otis | B63B 35/44 114/266 |
| 4,436,050 | A | 3/1984 | Liden | |
| 4,611,953 | A | 9/1986 | Owens | |
| 4,771,720 | A | 9/1988 | Yuzuriha | |
| 6,009,820 | A | 1/2000 | Kellog | |

(Continued)

FOREIGN PATENT DOCUMENTS

CN 20361218 U 5/2014

*Primary Examiner* — Stephen P Avila

(57) ABSTRACT

Semi-submersibles are subjected to loading from waves, causing racking, longitudinal shear and parallelogramming, or differential movement of the pontoons. The cyclic wave loading makes the various connections, where stress concentrations occur, susceptible to fatigue damage throughout the hull structure. This is most evident at the connections between the braces and the main hull structure. A revised brace to main hull connection with reduced bending stiffness is employed to reduce the moment being transferred from the brace to the hull, thereby reducing the bending stress and susceptibility to fatigue damage. This improved connection employs an internal member to transfer the loads between the brace and hull structure mainly as tension and compression. As a consequence of the improved fatigue performance, the structural weight of the connection can be greatly reduced, thus increasing the capacity with which the semi-submersible hull can operate.

6 Claims, 14 Drawing Sheets

(56) References Cited

U.S. PATENT DOCUMENTS

| | | | | |
|---|---|---|---|---|
| 6,378,450 | B1 | 4/2002 | Begnaud | |
| 7,887,262 | B2 | 2/2011 | Astrand | |
| 2009/0205554 | A1 | 8/2009 | Srinivasan | |
| 2013/0019792 | A1* | 1/2013 | Jahnig | B63B 1/04 114/267 |

* cited by examiner

BENDING STIFFNESS REDUCER FOR BRACE TO HULL CONNECTION

CROSS-REFERENCE TO RELATED APPLICATIONS

This application is a Non-Provisional Application claiming priority to U.S. Provisional Patent Application No. 62/302,905, entitled "Bending Stiffness Reducer for Brace to Hull Connection," filed Mar. 3, 2016, which is herein incorporated by reference.

STATEMENT REGARDING FEDERALLY SPONSORED RESEARCH OR DEVELOPMENT

This invention was not made under federally sponsored research or development.

REFERENCE TO SEQUENCE LISTING, A TABLE, OR A COMPUTER PROGRAM LISTING COMPACT DISC APPENDIX (IF APPLICABLE)

This is not applicable.

BACKGROUND OF THE INVENTION

This invention relates to mobile offshore units. Mobile offshore units are used in the offshore industry mainly for drilling and production operations, but also for general construction operations, crew accommodation, wind-turbine installation, etc. Semi-submersibles are a type of floating mobile offshore unit designed to provide a stable platform to support the necessary offshore operations in water depths where an on-bottom structure is not feasible.

The invention provides permanent means of structural connection, between the multiple hulls or multiple legs of the semi-submersible.

Semi-submersibles typically consist of a deck or deck box supported by a plurality of columns connected by large longitudinal pontoons and a series of transverse braces, at least two per vessel, typically one at the forward column and one at the aft column [see U.S. Pat. No. 4,436,050]. The braces extend from column to column, column to pontoon, or pontoon to pontoon, depending upon the design, but essentially, the braces connect parts of the main hull.

During operation, a semi-submersible is ballasted to a depth at which its longitudinal hulls are submerged, its columns penetrate the surface of the water and its braces are typically submerged. The hull can be partially de-ballasted to float at a reduced draft, to provide a greater clearance between the hull deck box and the surface waves.

In transit mode, a semi-submersible is completely de-ballasted resulting in it floating at its minimal draft. In this condition, it floats purely on the pontoons, with the columns completely above the water surface. The braces are typically above the water surface in this condition.

Weight in a semi-submersible is a critical design parameter. With Variable Deck Load around 15 percent of operating displacement, any lightship weight reduction has a multiplicative advantage to carrying capacity.

Throughout its life, a semi-submersible is subjected to global wave loadings which are resisted by the brace working in concert with the deck or deck box. Due to the wave loads on the semi-submersible, significant loading of the braces can occur, particularly at their connections.

The brace loading can be separated into two components; 1) an axial load due to squeeze/pry loads, where the hulls are forced together or pulled apart, by wave action, and 2) bending due to direct action of the waves perpendicular to the axis of the brace and due to the racking and parallelogram deflection, resulting in longitudinal and vertical displacement of the brace ends, relative to each other.

Considering that the wave loading is cyclical, the fatigue life considerations typically drive the design details, and scantlings of the brace members and their connections.

From this description, it can be appreciated that the braces of a semi-submersible are typically very robust and able to withstand compression, tension and bending loads, with due consideration made to assure adequate fatigue life. The brace is a beam column, with fatigue loading.

In the past, the approach has been to size the braces for the squeeze and pry forces, considering the minimum slenderness ratio required of the brace to withstand damaged condition loads and reinforce, or increase the cross-section at the end connection [see U.S. Pat. No. 4,771,720] of the brace ends to withstand the bending induced by the global parallelogram and racking deflections of the hull. Naturally, to achieve the required slenderness ratio, the braces are designed with a significant cross-section resulting in essentially a fixed ended brace. In a fixed ended traditional brace design, the bending stress is typically of the same magnitude as the axial stress, requiring heavy reinforcement to withstand the unintended parasitic bending stress.

Typically, from the brace at vessel centerline to their end connections at the hull, port and starboard, the brace walls are progressively increased in thickness to handle the hull deflection induced bending and its resulting cyclic fatigue stresses. Naturally, as the brace ends are reinforced, they are stiffened, and tend to attract more bending load, caused by the hull deflection. With greater load comes incremental stress, requiring increased reinforcement and weight.

Reinforcing the brace to hull connection increases the rotational stiffness of the connection, attracting more load, making reinforcement an ineffective way to address the connection fatigue issues. The reinforcement added to the brace is of little value to the vessel, other than to assure the survivability of the brace itself. The brace is intended to resist the axial squeeze/pry loads caused by hydrodynamic wave loading. The bending of the brace is the result of hull deflections over which the brace has no control. In other words, that bending is due to the hull parallelogram and racking deflections which are controlled by the stiffness of the hull box structure, which has orders of magnitude greater torsional stiffness than the braces, and therefore not greatly influenced by the stiffness of the braces. Increasing the stiffness of the braces to bending, only adds weight, without significantly reducing the magnitude of the hull deflection.

Besides having to keep the final stresses low to achieve adequate fatigue life, which finally requires very thick and heavy sections, the complex geometry at the intersection of the braces with the hull may require measures such as weld toe grinding and weld profiling [see CN 203,612,180] or making the entire hull to brace connection as a cast piece. As a result, the brace to hull connection can be very costly to construct, requiring lots of planning, inspection and lead-time.

Another brace solution has been to utilize more than 2 braces, per hull, typically two at the forward column and two at the aft column [see U.S. Pat. No. 6,378,450 B1]. As the squeeze and pry loads are shared, this arrangement has the advantage that the braces can be made smaller in cross-section and thereby less stiff. As a result, these braces attract less bending, given the same magnitude of hull deflections. However, this design suffers the same cost and weight deficiencies of the 2 brace design when the one brace damaged condition is considered.

It has been attempted to eliminate the braces entirely and rely on the columns and deck box connection to withstand the squeeze and pry forces [see U.S. Pat. No. 6,009,820]. This arrangement converts squeeze and pry forces between the pontoons from axial loads on the braces to loads which create bending moments at the column to deck box connection and increase the bending due to racking at the column to deck box connection. In practice, this arrangement resulted in deck box plate cracking, at the column to deck box connection, and braces were retrofitted to take the squeeze and pry loads directly, thereby reducing the deck box deflections to acceptable limits.

Other designs have added a truss-work of braces to prevent hull relative deflection and brace end relative displacement, but this results in a still heavier structural design.

SUMMARY OF THE INVENTION

The present invention looks to reduce the rotational stiffness of the brace to hull connection, thereby reducing the induced bending moment and reducing the need for local reinforcement requirements of the connection needed to achieve the target fatigue life. By reducing the local reinforcement requirements, a reduced structural weight of the brace connection can be attained, resulting in greater Variable Deck Load capacity. The brace with reduced bending stiffness withstands the squeeze/pry loads, for which it was intended, without attracting significant bending stresses from the hull deflection, which is controlled by the deck box.

It is therefore, an objective of this invention to provide a means of connecting a brace such to reduce the bending stress at the connection.

It is therefore, an objective of this invention to provide a brace connection on a semi-submersible with improved fatigue performance by providing a means for reducing the end moment in a structural brace member, and thereby greatly reducing the bending stress at its connection.

It is therefore, an objective of this invention to provide a brace connection with less weight than a standard connection and thus provide an increased semi-submersible hull payload.

The objectives of the present invention are achieved by a brace connection that is optimized to transfer the loads on the brace as compression and tension as opposed to compression and tension in combination with high moment.

This is accomplished by designing the brace to act more like a pin-ended column and less like a fixed end column.

Rather than connect the brace at its end through a constant or enlarged section, reinforced to withstand induced bending, this invention reduces the stiffness of the of the axial load bearing member of the brace at that connection, resulting in an end element which is more flexible in bending.

BRIEF DESCRIPTION OF THE DRAWINGS

So that the basic need fulfilled by and demands placed upon the brace can be better understood, the drawbacks of the prior art appreciated and improvement on and benefits from this invention revealed, a more particular description and invention embodiments is provided in the following figures, followed by their detailed description. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
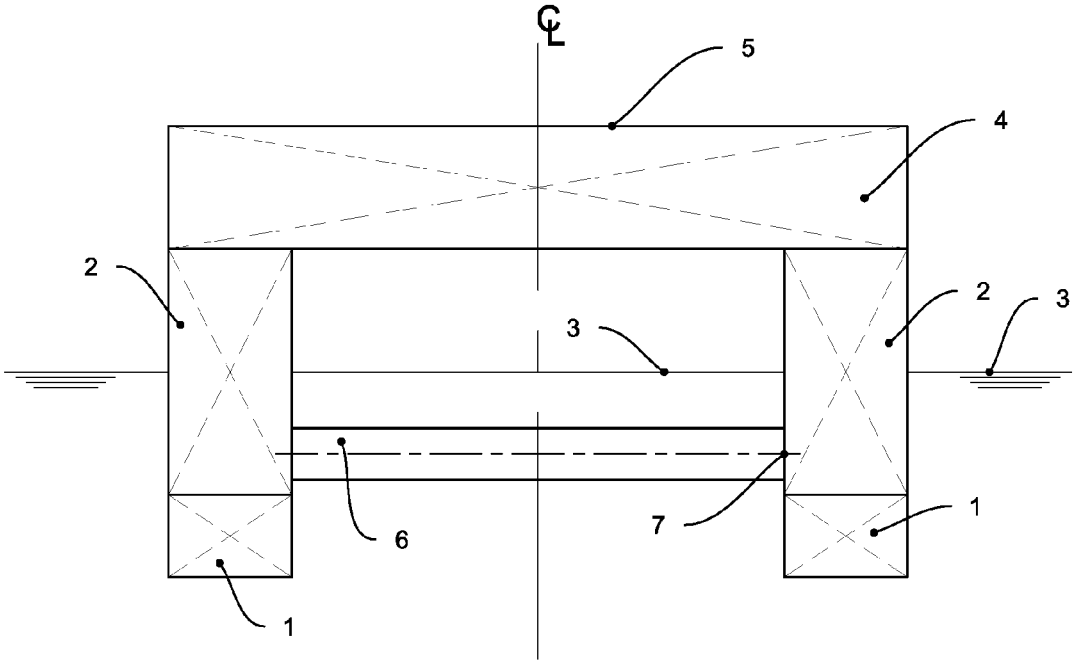
FIG. 1 is a typical structural arrangement showing a semi-submersible in section view.
Figure 2:
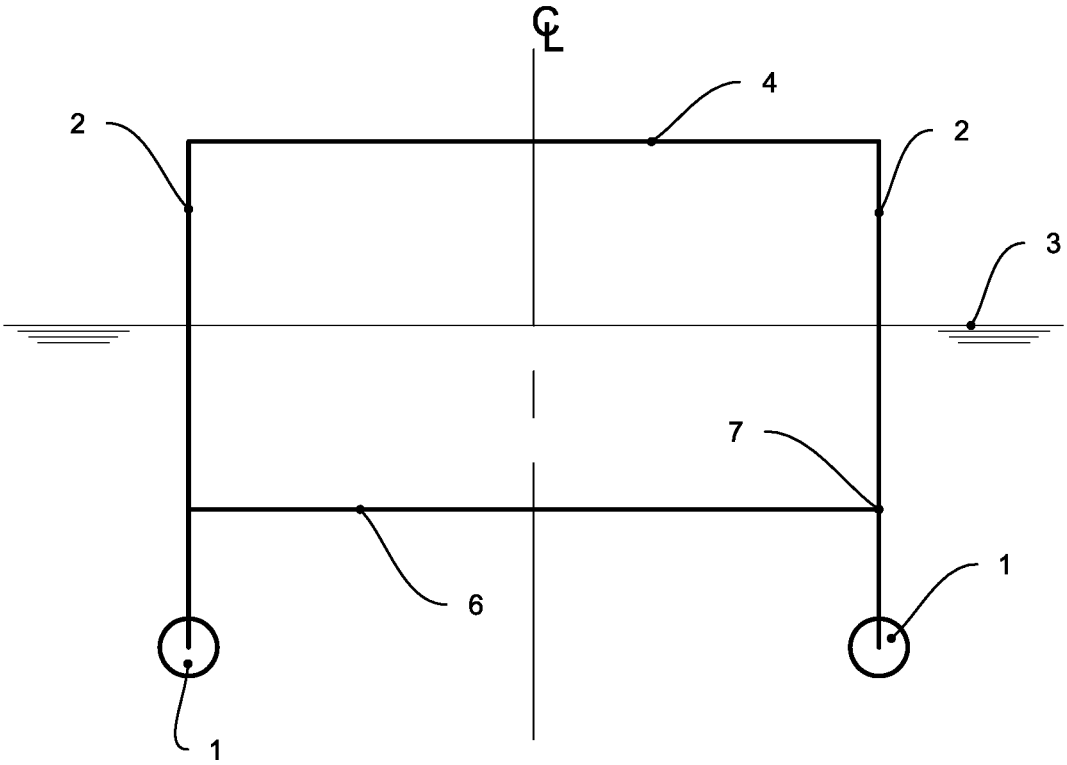
FIG. 2 is a typical structural arrangement showing a semi-submersible in section view, in a diagrammatic representation.

Referring now to the invention in more detail, a typical structural arrangement is shown in FIG. 1, showing a semi-submersible in section view and FIG. 2, shows a semi-submersible in section view in a diagrammatic representation. A semi-submersible, or more particularly the main hull structure of a semi-submersible is typically composed of a series of pontoons 1, columns 2, and an upper box structure 4. The hull of the semi-submersible is buoyant, operating at a waterline 3 approximately as indicated. The main deck 5 structure varies in its arrangement depending upon the intended use of the semi-submersible such as drilling, oil production, construction support, accommodations, etc. The brace structure 6 is shown, in this case, the standard way with built-in, or fixed ends 7.

Figure 3:
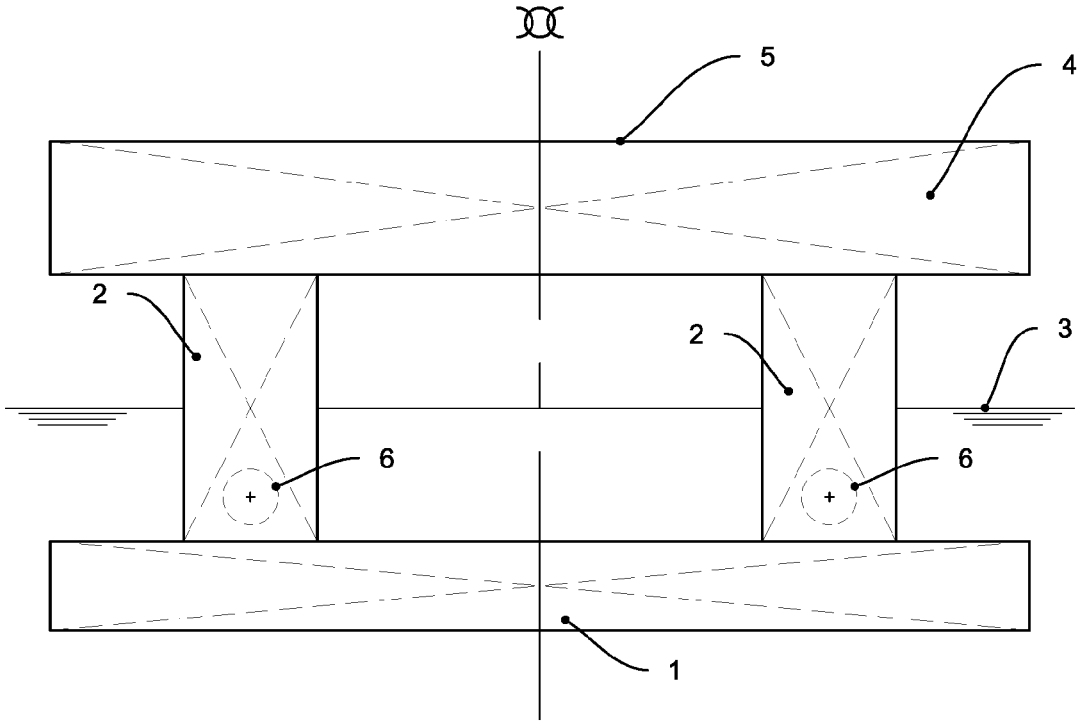
FIG. 3 is a typical structural arrangement showing a semi-submersible in profile view.

For better understanding, FIG. 3 shows a semi-submersible in profile view, showing the same elements as in the section view, pontoons 1, columns 2, operating waterline 3, deck box 4, main deck 5 and brace structure 6.

Figure 4:
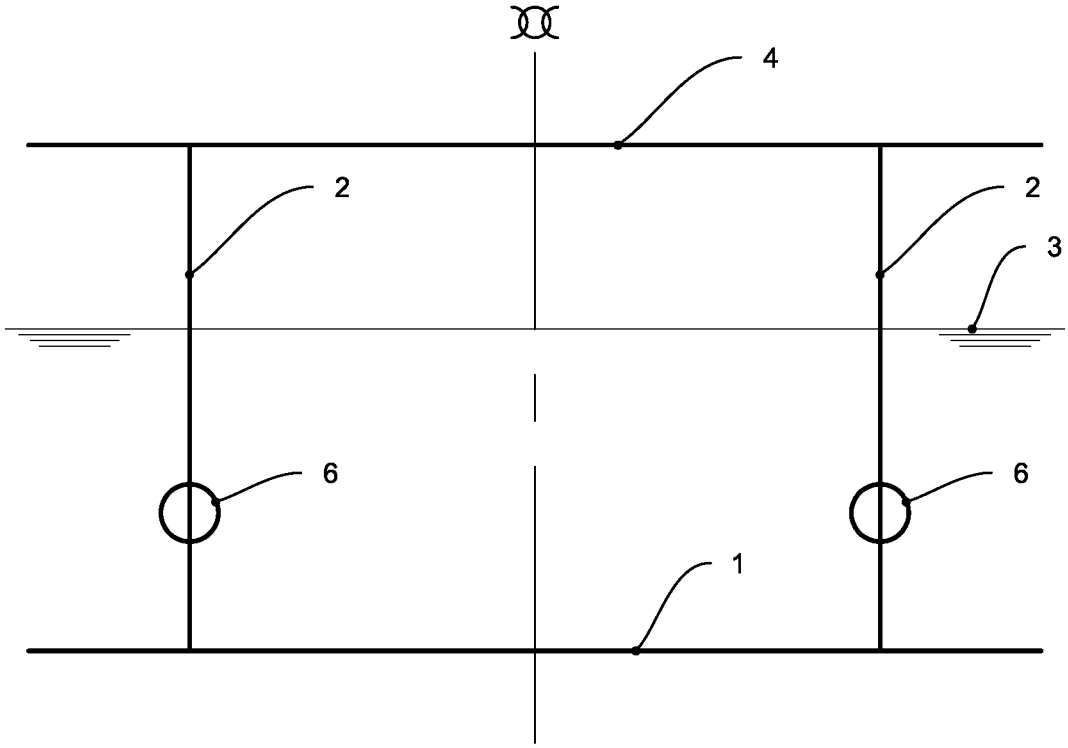
FIG. 4 is a typical structural arrangement showing a semi-submersible in profile view, in a diagrammatic representation.

FIG. 4 shows the diagrammatic representation of the semi-submersible in profile view, showing pontoons 1, columns 2, operating waterline 3, deck box 4, and brace structure 6.

Throughout its life, a semisubmersible is subjected to global wave loadings which are resisted by the brace 6 working in concert with the deck or deck box 4. When the semisubmersible is in beam seas, the pontoons 1 are alternatively pried apart and squeezed together and rolled into a parallelogram shape, by the passing waves. To prevent undue bending moment at the column 2 to deck box 4 connection, the braces 6 are intended to take the tension 8 and compression 13 loads generated by the hull-wave interaction as depicted in FIGS. 5 and 6, respectively.

Figure 5:
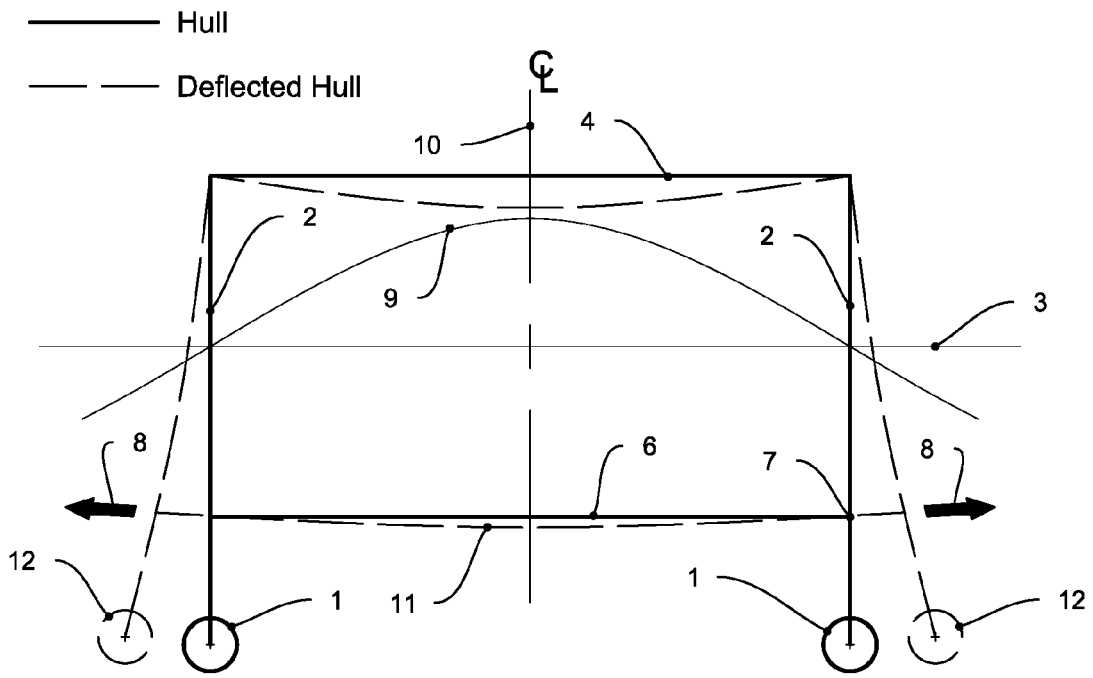
FIG. 5 is the diagrammatic section view showing a depiction of the behavior of the brace members in pry, with the brace in tension.

FIG. 5 shows the semi-submersible in diagrammatic section view to illustrate the tension loads 8 the braces 6 are intended to carry, which are tension loads 8 when the wave crest 9 is at the semi-submersible centerline 10, and the pontoons are pried apart 12. The brace 6 is deflected with the tension loads 8 in this scenario primarily down 11, with little bending induced in the brace to column connections 7.

Figure 6:
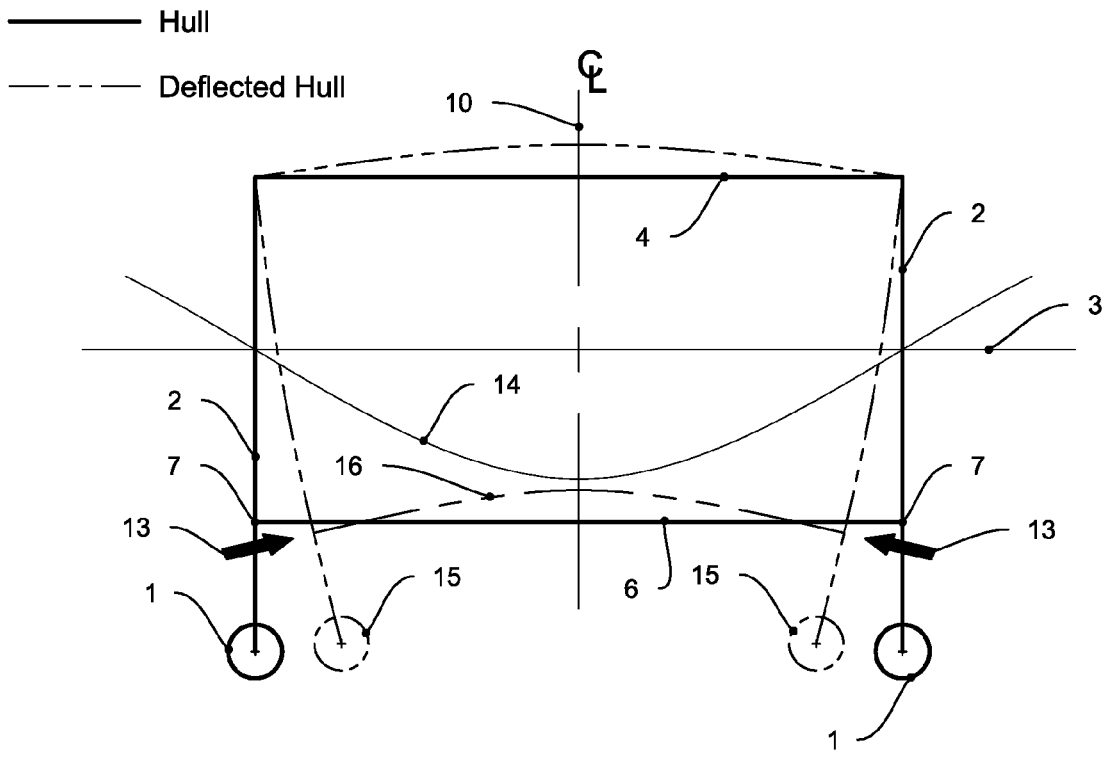
FIG. 6 is the diagrammatic section view showing a depiction of the behavior of the brace members in squeeze, with the brace in compression.

FIG. 6 shows the semi-submersible in diagrammatic section view to illustrate the compression loads 13 the braces 6 are intended to carry, when the wave trough 14 is at the semi-submersible's centerline 10 and the pontoons are squeezed together 15. The brace 6 is deflected with the compression loads 13 in this scenario primarily up 16, with little bending induced in the brace to column connections 7.

Figure 7:
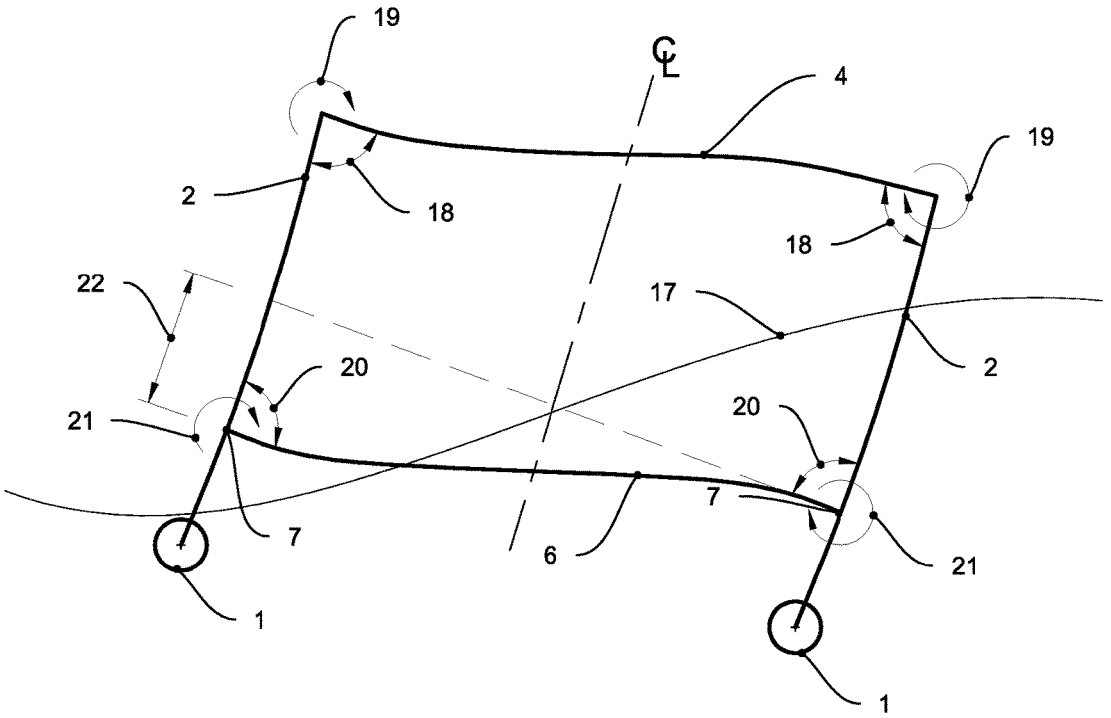
FIG. 7 is the diagrammatic section view showing a depiction of the semi rolling and the brace behavior with fixed end connections, as the hull parallelograms.

Referring now to FIG. 7, as a wave 17 approaches, the semi rolls, the ring formed in section view by the deck box 4, columns 2 and horizontal brace 6 will parallelogram. The connection between the deck box 4 and columns 2 is rigid 18, and transmits moment 19 to resist the deflection. In the prior art, the connection between the brace and columns 7 is also rigid 20 and the deflection of the hull distorts the braces 6 into an "S" shape, with a radius of curvature at the connection 7 "Rho," resulting in bending moment 21 at the brace to column connection 7. The maximum stress along the brace 6 is then seen at the brace to column connection 7. The cyclical nature of the bending due to wave loading makes the brace to column connection 7 susceptible to fatigue damage.

Because the deck box 4 is orders of magnitude stiffer than the braces 6, the deck box 4 resists this load, but the hull still suffers significant flexure. The braces 6 adapt to the slope of the columns 2 at their ends 7. This flexure, from the perspective of the horizontal brace 6 looks like vertical displacement of the brace ends 22, free to translate vertically but not rotate 20. This distorts the brace into an "S" shape in section view, creating bending moment in the brace 21. As a result, the brace is not a purely tension 8—compression 13 member, but a beam column, suffering bending moment 21 due the interaction of its fixed ends 7 and the inevitable hull deflection, in addition to either the tension 8 or compression 13 load.

Figure 8:
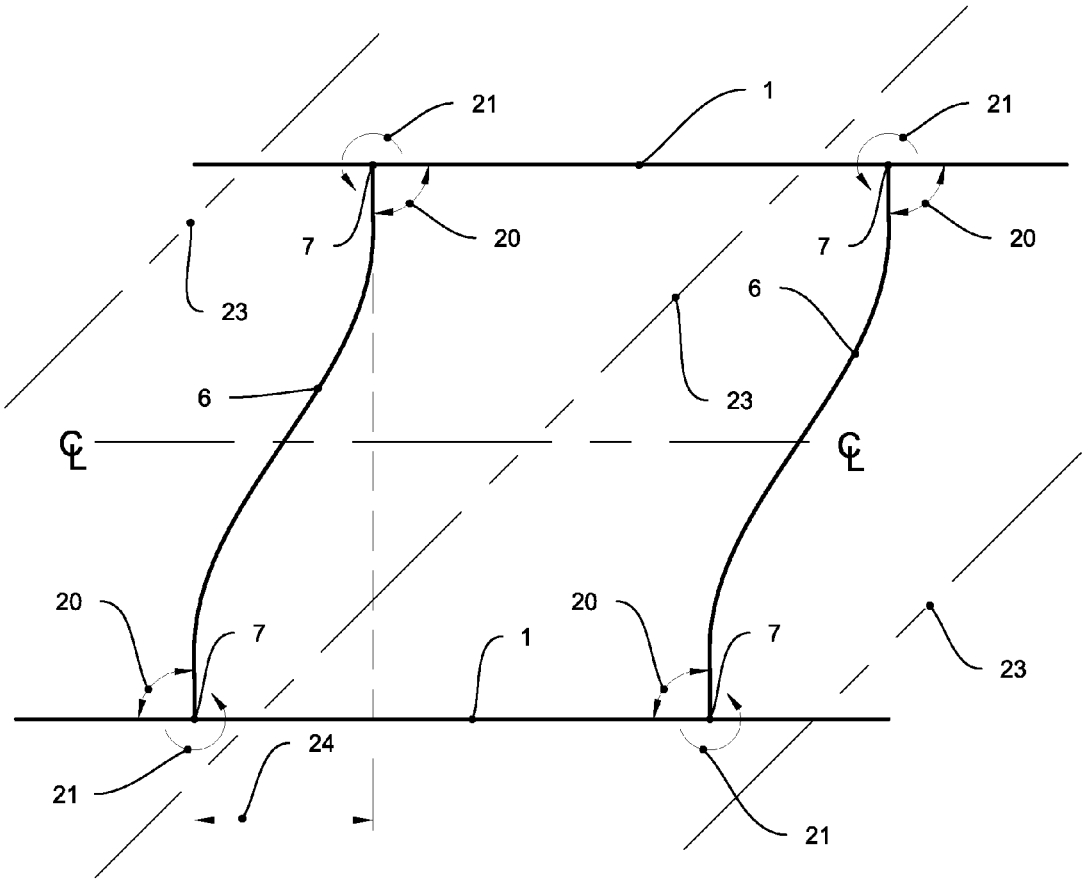
FIG. 8 is a diagrammatic plan view, showing a depiction of the longitudinal racking displacement of the hull in quartering waves and brace behavior with fixed end connections.

Similarly, when the hull is in quartering seas 23, as shown in FIG. 8, the hull racks, which moves the two pontoons 1 longitudinally relative to one another 24, resulting in the brace 6 adopting an S-shape in plan view due to the rigidity of its end connection 20. This deflection is analogous to the deflection described in FIG. 7, however this form of hull deflection causes brace bending 20 in the horizontal plane.

These vertical 22 and longitudinal 24 deflections can be quite high and the parallelogramming and racking deflection induced brace bending 21 stresses are typically roughly equivalent to the brace axial stresses caused by prying 12 and squeezing 15. However, because the deck box 4 is orders of magnitude stiffer than the braces 6, reinforcing the brace ends 7 does not appreciably reduce the hull flexure, it only reinforces the braces 6 locally, attracting more bending moment 21 and adding weight and cost to the hull.

For minimum weight, the sole purpose of the brace 6 should be to resist the pry 12 and squeeze forces 15 on the pontoons 1 and columns 2, while the loads from parallelogramming, as shown in FIG. 7, and racking, as shown in FIG. 8, deflections of the hull should be resisted by the deck box 4.

Figure 9:
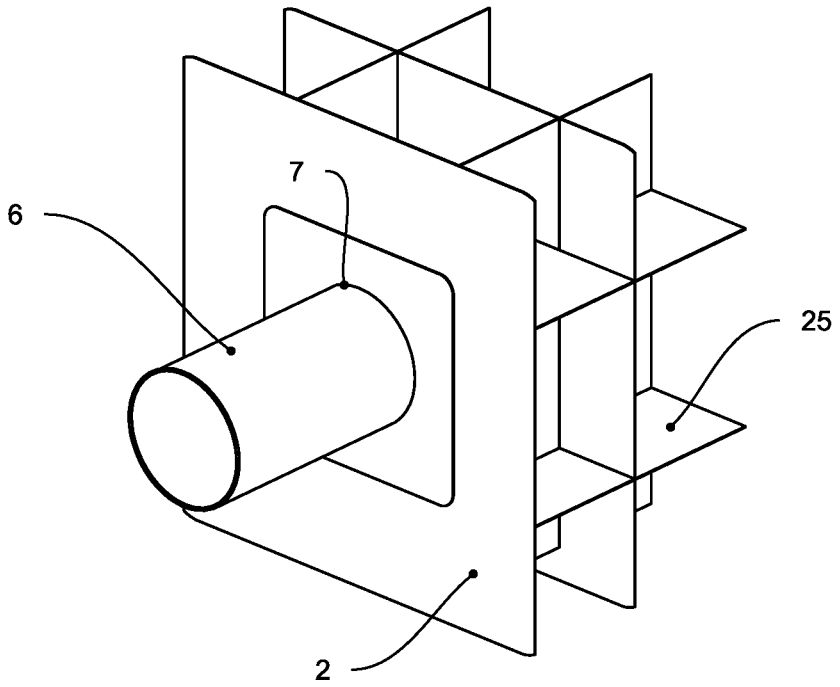
FIG. 9 is an isometric view of the standard brace to hull connection in isometric view.
Figure 10:
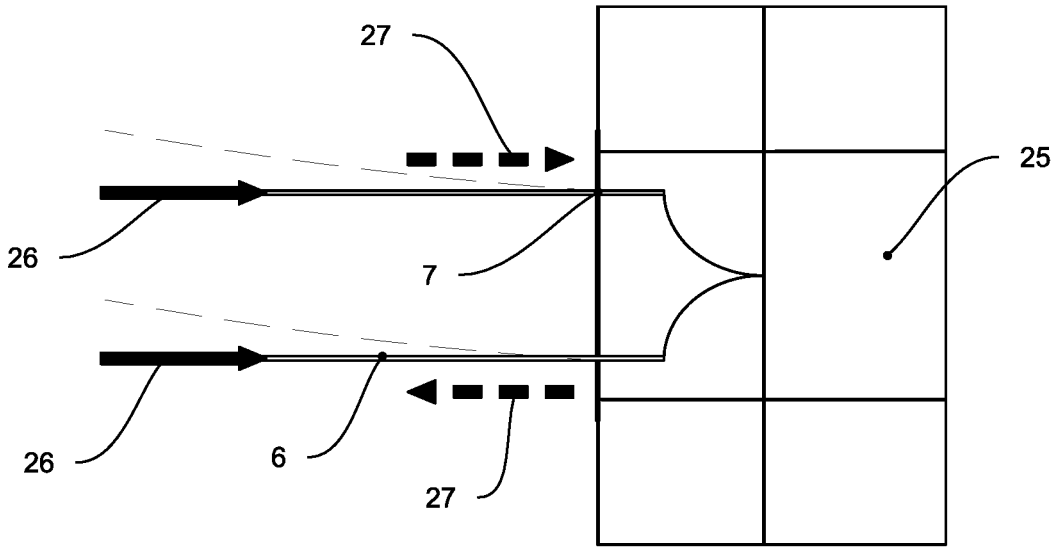
FIG. 10 is a profile section view showing axial plus bending loads at the standard brace to hull connection.

FIG. 9 shows the standard brace 6 to hull 2 connection, where typically, a brace 6 with a large cross-section is connected 7 to the hull 2 and backed up with hull internal structure 25 to resist both the axial 26 and bending 27 loads, as shown in FIG. 10. With such a large cross-section for the brace 6, connected 7 to the hull structure 2, it is inevitable that the hull deflection induces large magnitude bending 27.

Clearly, what is needed is to decouple the brace 6 from bending due to hull deflection, as depicted in FIGS. 7 and 8, by reducing the bending stiffness of the brace 6 to hull 2 connection 7. In this way, the brace can be sized optimally, for tension 8 and compression 13 loads, without attracting bending moments 21 which do not significantly reduce those hull deflections.

Figure 11:
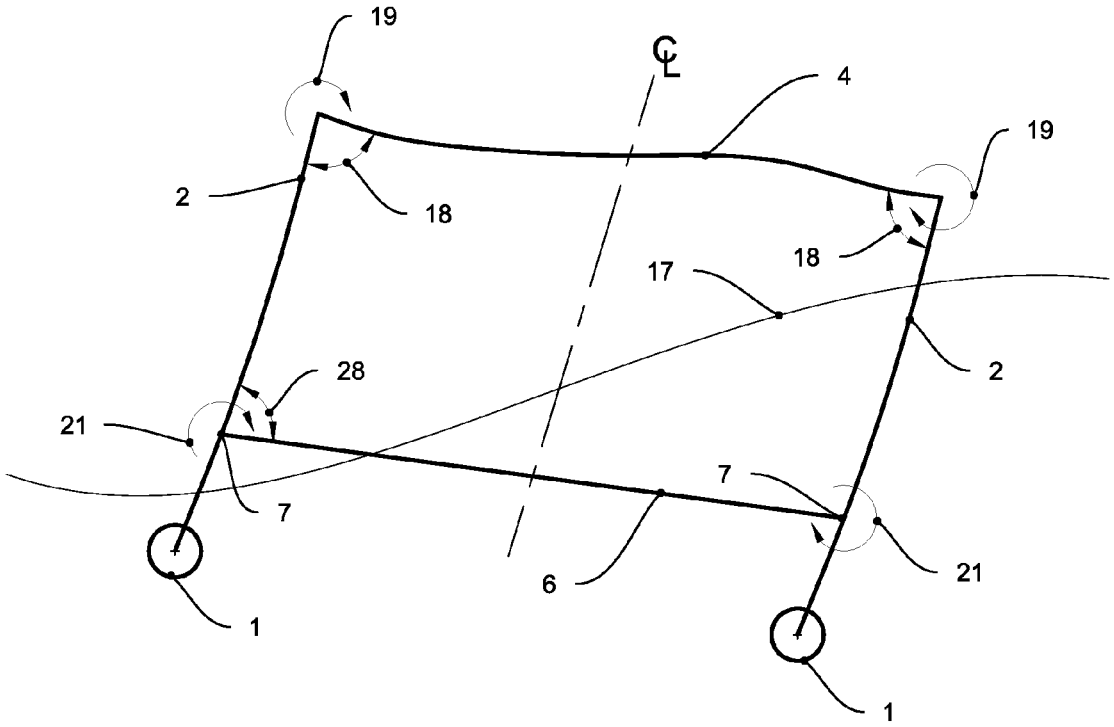
FIG. 11 is the diagrammatic section view showing a depiction of the semi rolling and the brace behavior with hinged end connections, as the hull parallelograms.
Figure 12:
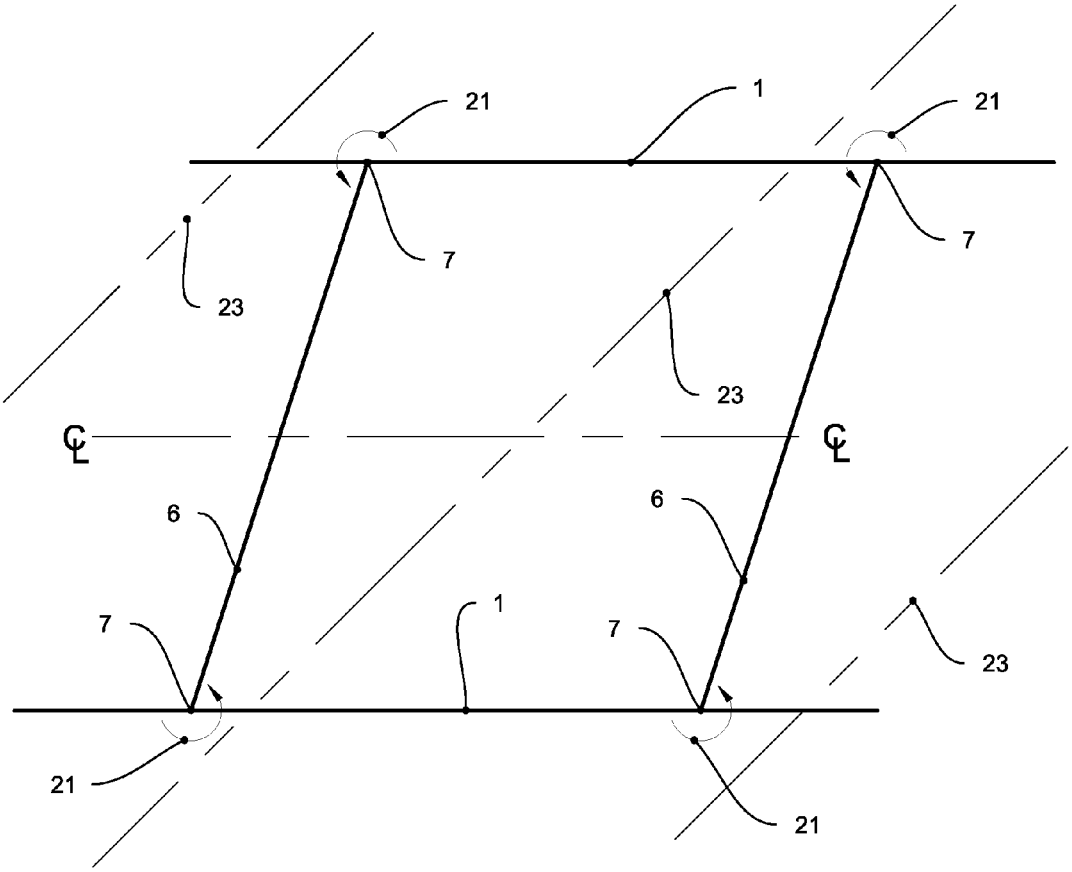
FIG. 12 is a diagrammatic plan view, showing a depiction of the longitudinal racking displacement of the hull in quartering waves and brace behavior with hinged end connections.

FIGS. 11 and 12, in a way analogous to FIGS. 7 and 8 respectively, show how braces 6 free to rotate at their ends 7 do not induce bending 21 in the brace. As a result, they can be designed for almost pure axial tension 8 and compression 13, without being reinforced to withstand and attract bending moments 21. From FIGS. 11 and 12, it can be appreciated that the braces 6 do not adopt an "S" shape, but instead remain virtually straight, with their end moments 21 greatly reduced.

The following embodiment is considered to be the preferred means for achieving this invention. Other arrangements may exist, which reduce the bending stiffness of this connection, so are intended to be hereby covered by the disclosure of this invention.

Figure 13:
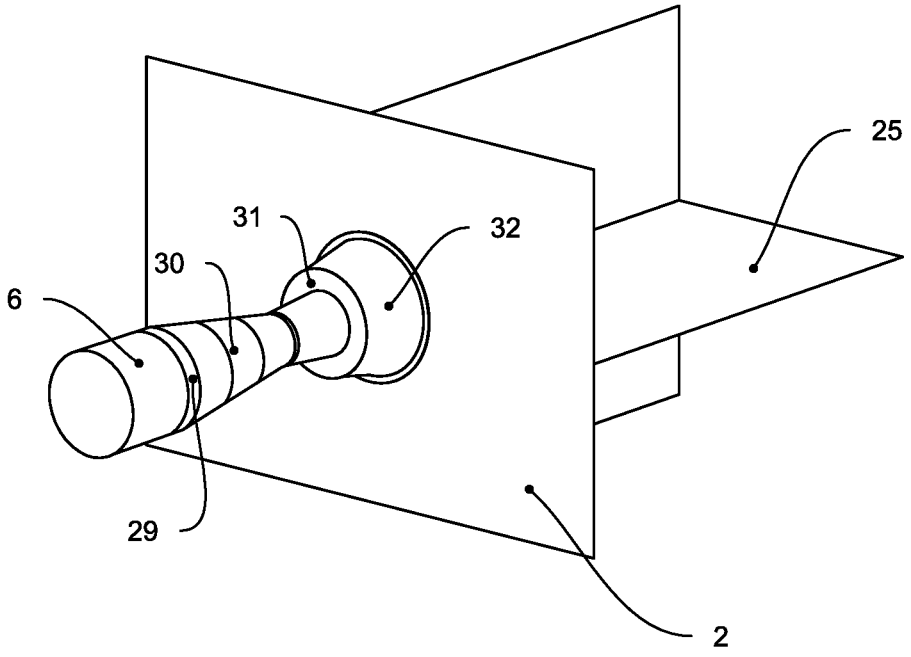
FIG. 13 is an isometric view of the improved brace to hull connection in isometric view.
Figure 14:
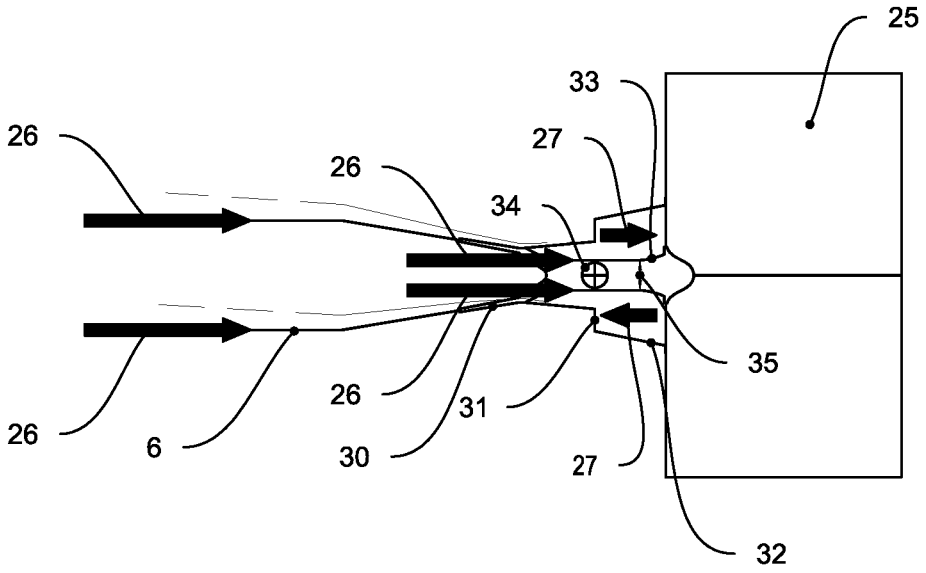
FIG. 14 is a profile section view showing axial plus greatly reduced bending loads at the improved brace to hull connection

The preferred embodiment of this invention is shown in FIGS. 13 and 14. In FIG. 13, it can be appreciated that the design begins with the full cross-section of the brace 6 but after transitioning through an outer band of increased thickness 29, for local strength, the cross-section is reduced conically through a conical transition piece 30 which attaches to the flexible element 33, which is of reduced cross-section 35. A central flexing element 33 is disclosed, with one end of the flexing element 33 fixed to the hull structure 25 and the other end fixed to the brace 6 as shown in FIG. 14. Owing to the minimal cross-section of this element 33, the structure of the brace connection has a reduced "y" (distance from the neutral axis to the extreme fiber of the element in bending) from that employed on the brace itself for a reduced moment attraction. This cylindrical flexing member 33, internal to the brace 6, has a high axial load 26 capacity allowing for the safe transfer of loading as tension 8 or compression 13, without attracting significant bending stresses 21 due to hull deflections. Pictorially, this is represented by the same axial loads 26, but greatly reduced bending loads 27. As a consequence, detailed analysis has proven that the backing structure 25 is also of less weight as it is withstanding primarily axial loads 26, rather than roughly equal amounts of axial stress 26 and bending stress 27.

To withstand transverse loads and to align the flexing element with its axial loads, the brace end is constrained from transverse translation by a "Warping Plate 31," which can withstand angular deflection at the flex member 33, while behaving rigidly in a direction radial to the brace 6. The warping plate 31 can flex to accommodate angular deflection of the brace 6 about the center of pivot 34 at the flex element 33, mid-span, with minimum stress, due to it being relatively thin plate material, on the order of thickness of the rest of the hull in that area. At the same time, the warping plate 31 is very rigid to in-plane-shear, so maintains the brace 6 end, and consequently its central flex element 33, at the center of axial force 26 action and pivot center 34. The warping plate 31 also transmits any transverse loads imparted to the brace 6, into the hull structure 25 through the outer transition piece 32.

What is claimed is:

1. A floating structure being capable of use offshore, with said floating structure being made up of a number of components including (a) one or more pontoons;

(b) one or more columns;

(c) one or more decks; and (d) one or more connecting members capable of withstanding axial and transverse loads, wherein each connecting member is fixedly attached at each end to one of the other components, and wherein at least one end of said connecting member is attached to another component through a flexible element capable of bending upon translation or rotation of the attached component to provide translational rigidity with minimal flexural rigidity at the end-connections through the flexible element, wherein the flexible element is fixedly attached at a first end to said connecting member and fixedly attached at a second end to one of the other components, said flexible element being centralized by a warping plane, intersecting said flexible element at approximately its mid-span, said warping plane acting as a gimbal, and is fixedly attached in a direction approximately perpendicular to said flexible element to both said connecting member and said other component at distinct diameters of said warping plane, to allow rotation of the connecting member about the approximate mid-span of the flexible member, while preventing translation of said connecting member in a direction perpendicular to the axis of said flexible element at the point of intersection between said warping plane and said flexible element.

2. The floating structure of claim 1 in which said flexible element is cylindrical, or planar, having a dimension in the direction of bending which is less than its dimension in its axis of bending.

3. The floating structure of claim 1 in which said flexible element has been forged, or cast, or welded, or bolted, or riveted or any combination of the aforementioned.

4. The floating structure of claim 1, in which said flexible element is made of steel, or titanium, or aluminum, or fiberglass, or carbon fiber or any combination of the aforementioned.

5. The floating structure of claim 1, in which said warping plane is comprised of plate, or of corrugated plate, or of two or more layers of plate, or any combination of the aforementioned.

6. The floating structure of claim 1 in which said warping plane is comprised of elastomeric elements which act alone or in combination with the affixed other component to centralize and prevent movement of the said connecting member in any direction transverse to the axis formed by its points of attachment.

* * * * *